US010202785B2

(12) United States Patent
Overgaard

(10) Patent No.: US 10,202,785 B2
(45) Date of Patent: Feb. 12, 2019

(54) UNIVERSAL CONTROL MODULE FOR ELECTRICAL LOCK, RETROFIT AND METHOD FOR OPERATING

(71) Applicant: DANALOCK IVS, Harlev J (DK)

(72) Inventor: Henning Overgaard, Harlev J (DK)

(73) Assignee: DANALOCK IVS, Harlev J. (DK)

( * ) Notice: Subject to any disclaimer, the term of this patent is extended or adjusted under 35 U.S.C. 154(b) by 0 days.

(21) Appl. No.: 15/771,415

(22) PCT Filed: Oct. 27, 2016

(86) PCT No.: PCT/DK2016/050341

§ 371 (c)(1),
(2) Date: Apr. 27, 2018

(87) PCT Pub. No.: WO2017/071712

PCT Pub. Date: May 4, 2017

(65) Prior Publication Data

US 2018/0313115 A1 Nov. 1, 2018

(30) Foreign Application Priority Data

Oct. 29, 2015 (DK) ..... 2015 70698

(51) Int. Cl.
*E05B 47/00* (2006.01)
*E05B 47/02* (2006.01)
*G07C 9/00* (2006.01)

(52) U.S. Cl.
CPC ..... *E05B 47/026* (2013.01); *E05B 47/0002* (2013.01); *G07C 9/00571* (2013.01);
(Continued)

(58) Field of Classification Search
CPC ..... E05B 47/026; E05B 47/0002; E05B 2047/0058; E05B 2047/0091;
(Continued)

(56) References Cited

U.S. PATENT DOCUMENTS 5,083,448 A 1/1992 Karkkainen et al.
8,552,875 B2 * 10/2013 Burdenko ..... E05B 47/026 340/5.26

(Continued)

FOREIGN PATENT DOCUMENTS

WO WO 2006/098690 A1 11/2006
WO WO 2011/128901 A1 10/2011

OTHER PUBLICATIONS

International Search Report—PCT/DK2016/050341.

(Continued)

*Primary Examiner* — Thomas D Alunkal
(74) *Attorney, Agent, or Firm* — Schmeiser, Olsen & Watts, LLP

(57) ABSTRACT

A control unit for retrofit to electromechanical or magnetic door locks is provided. The control unit includes a casing with an electrical exit port that is connected to the electrical connectors of a standard electromechanical door lock in order to provide an additional way of controlling the lock. Especially, the external control unit receives lock commands from a mobile device, such as a telephone, for locking or unlocking the door lock.

15 Claims, 4 Drawing Sheets

(52) U.S. Cl.
CPC ..... *E05B 2047/0058* (2013.01); *E05B 2047/0091* (2013.01); *G07C 2009/00634* (2013.01); *G07C 2009/00769* (2013.01)

(58) Field of Classification Search
CPC ..... G07C 9/00571; G07C 9/00309; G07C 2009/00634; G07C 2009/00769
See application file for complete search history.

(56) References Cited

U.S. PATENT DOCUMENTS

| | | | | |
|---|---|---|---|---|
| 9,534,420 | B1 * | 1/2017 | Cheng | G07C 9/00571 |
| 2002/0183008 | A1 * | 12/2002 | Menard | G07C 9/00182 455/66.1 |
| 2008/0258867 | A1 * | 10/2008 | Harris | E05B 47/0012 340/5.64 |
| 2015/0194000 | A1 * | 7/2015 | Schoenfelder | G07C 9/00309 340/5.61 |
| 2015/0199863 | A1 * | 7/2015 | Scoggins | G07C 9/00904 340/5.25 |
| 2015/0240531 | A1 * | 8/2015 | Blust | G07C 9/00571 340/5.5 |
| 2017/0051533 | A1 * | 2/2017 | Kester | E05B 47/0012 |

OTHER PUBLICATIONS

Written Opinion—PCT/DK2016/050341.
Danish Search Report dated Jul. 14, 2016 for Application PA 2015 70698.

* cited by examiner

UNIVERSAL CONTROL MODULE FOR ELECTRICAL LOCK, RETROFIT AND METHOD FOR OPERATING

CROSS-REFERENCE TO RELATED APPLICATIONS

This application claims priority to PCT Application No. PCT/DK2016/050341 having a filing date of Oct. 27, 2016, which is based on DK Application No. PA 2015 70698, having a filing date of Oct. 29, 2015, the entire contents both of which are hereby incorporated by reference.

FIELD OF TECHNOLOGY

The following relates to wireless control modules for electromechanical locks. In particular, it relates to retrofit of a control unit to an already existing electrically operated door lock in order to provide a secondary tool for operating an existing lock.

BACKGROUND

Electromechanical door locks are operated by various methods, for example by a wired remote control, which in the simplest form is a push button provided remotely from the door, for example in an apartment remotely from the entrance door of the building. For accessing a building, it is also known to use keypads that are configured to open a lock when receiving an input of a predetermined alphanumerical code. Furthermore, wireless communication systems between locks and remote controls are common, such as based on infrared signals. The latter type of communication is typically used in garage doors, the term door here including various types of garage ports. Typically for each type of lock, there is a specific type of communication, and one infrared remote, typically, can only be used for a single lock.

Generally, latest modern locks, which are telephone operated for locking and opening, are becoming increasingly common, not only to provide better comfort to the user but also for improving the security. However, the change from an older, simpler lock type to the modem advanced lock system is an expensive and mechanically not always easy task. Especially, the fitting of the door lock inside door panels may require that the door itself is modified or changed, which is often not desired. Also, the existing remote operation of door locks typically has to be changed, which is not always wanted, especially when a certain system is well established.

For this reason, it is desirable to provide a retrofit lock system for electromechanical door locks which is easy to install. Especially, for such system, it is desirable to provide a retrofit system that provides the same high security, including encrypted communication, and versatility as modern type telephone operated door locks, preferably, including the use of one telephone for operating various locks. Also, it is desirable to provide a retrofit improvement such that a large variety of locks can be operated with a single wireless device.

SUMMARY

An aspect relates to a universal module that can be operated by wireless signals, especially from a mobile phone, and which can be configured for control of a large variety of electromechanical door locks. A further aspect is to provide the module for retrofit on existing locks. These aspects are obtained with a retrofit wireless control system and method for electromechanical locks as explained in more detail in the following.

The retrofit system as described in the following concerns retrofitting and operating an external control unit provided to an existing electrically activated door lock for causing locking and unlocking by the retrofitted external control unit. Such system is especially suitable for the following type of lock.

The door lock comprises a locking mechanism that is electrically controllable for keeping the door closed or open upon activation of the locking mechanism by electrical power. For example, the door lock is of the electromechanical type and comprises an extendable-retractable lock bolt in a door panel co-operating with a notch in a door frame. Alternatively, the locking mechanism comprises a movable shutter co-operating with a lock bolt, the movable shutter typically provided in the frame of a door. A combination of these two is also possible. The lock bolt or the shutter, are driven by an electromechanical driving unit, for example motor or solenoid, which in the case of a lock bolt is typically mounted inside the door panel, also called door leaf, and which in case of the shutter typically is mounted inside the door frame, as it is typical in strike locks.

In such electromechanical locks, the locking mechanism is activated by current from a first power supply that is electrically connected to the locking mechanism by a first electrical wire connection causing activation or deactivation of the locking mechanism by electrical power from the first power supply, for example comprising an electrical relay, to the locking mechanism through the first wire connection. A first power source, for example a battery, a generator, or a connection to the public power grid, is electrically connected to the first power supply by a second wire connection for providing power to the first power supply. The first power supply, for example comprising relay, is optionally provided in or on a casing for the lock but can also be provided remotely from the lock casing.

As a different alternative, the locking mechanism is a magnetic lock without a driving unit.

In order to control the first power supply, for example comprising an electrical relay, a first controller is functionally connected to the first power supply for causing the first power supply turning on or off electrical power from the first power source through the second wire connection, further through the first power supply, and through the first wire connection to the locking mechanism. In the simplest form, the controller is a push button or door handle. In more advanced systems, the controller is an alphanumeric key pad, a remote control or a mobile device, such as a mobile telephone or pager. This type of lock is of traditional type and commonly used.

For extension of the capabilities in controlling the door lock, an external control unit is provided in addition to the first power supply and the first power source and the first controller. Thus, it is an additional control unit for retrofit, which is provided, installed, and operated at a substantial later time than the mounting of the door lock, for example at least one month or even at least one year later, although, typically, it is several years later.

The external control unit comprises a second power source different from the first power source and configured for supply of electrical current suitable to drive the locking mechanism in addition to driving the locking mechanism by the electrical current from the first power source.

The external control unit comprises a housing, inside which a microprocessor is provided as well as a short range wireless digital data signal transceiver that can communicate with a wireless device, such as a mobile telephone. The transceiver is electronically connected to the microprocessor for exchange of digital data signals between the transceiver and the microprocessor. The microprocessor is programmable for operation of the lock when receiving commands from a mobile device, such as a mobile telephone, especially a smartphone.

For example, in such case, the smartphone would be equipped with a computer application, a so-called APP, which provides the user with a suitable user interface on the display of the smartphone, facilitating the locking and unlocking of the door lock. Also, such APP can be used to automatically cause opening of the door by using of the external control unit when the smartphone is in the vicinity of the external control unit.

The external control unit comprises a first electrical connection port in the housing for providing of electrical power to the lock by a wire connection between the connection port and the lock. Typically, the external control unit would be provided on the door panel or the frame, depending on the location of the driving unit, but it can also be mounted at some distance, although typically within a distance of a few meters and seldom at more than a 10 meter distance. Inside the housing, first electrical connection port is connectable via a first switch mechanism to the second power source for receiving electrical current from the second power source. The microprocessor is operationally connected to the first switch mechanism and configured for causing the first switch mechanism switching on and off the current through the first connection port according to programmed operational steps in the microprocessor.

The current from the first electrical connection port can optionally be used for directly operating a lock mechanism, such as a solenoid or motor. However, some locks comprise a first power supply with an electrically operated relay that opens or closes supply of electrical current from the first power source. The external control unit can then instead be used to operate the lock directly or to operate the electrically operated relay of the first power supply.

For example, the user or installing person identifies that the door lock comprises a relay as part of the power supply or not, and in the case that the power supply does not comprise a relay, the first connection is identified which is giving electrical access to the locking mechanism and the third wire connection is electrically connected to the first connection port of the external control unit and to the first wire connection. Upon receipt of the digital command by the microprocessor the locking mechanism is operated by the external control unit in the following way. Current is fed from the second power source through the first connection port of the external control unit to the locking mechanism and via the third wire connection and via the first wire connection. The external control unit, thus, works as a further mechanism of operating the lock directly.

In the case that the power supply does comprise a relay, the user or installer is identifying whether the relay comprises a current input to the relay for operating the relay by an external current. In the affirmative, the third wire connection is electrically connected to the first connection port. Upon receipt of the digital command by the microprocessor the locking mechanism is operated by the external control unit in the following way. Electrical current is fed from the second power supply via the first connection port via the third wire connection to the relay. The external control unit, thus, works as a further mechanism of operating the lock by operating a relay of the first power supply.

Some relays do not cause locking or unlocking by supply of external power but use an electrical circuit which when closed or broken causes the relay to initiate locking or unlocking of the door. For example, such circuit can be closed by a simple push button.

For such types of relays in the first power supply, the further feature is useful. For such cases, the external control unit comprises a further electrical connection port provided with a two-pole wire connector with a second switch mechanism between its two poles for electrically connecting or disconnecting the two poles with each other. These are used for operating the lock by connecting or breaking a current circuit. The microprocessor is operationally connected to the second switch mechanism for causing it electrically connecting or disconnecting the two poles with each other according to programmed operational steps in the microprocessor. The further electrical connection port or ports of the external control unit can then be electrically connected by a wire connection to the lock as an additional control for locking or unlocking the lock.

For example, the user or installing person identifies that the door lock comprises a relay as part of the power supply or not, and in the case that the power supply does comprise a relay, it is identified whether the relay comprises two current output poles for operating the first power supply in dependence of the current output poles being electrically connected to each other or not. In the affirmative, the two-pole wire connector of the further connection port is electrically connected with the two current output poles of the relay in the first power supply by the third wire connection. As a consequence of receiving the digital command by the microprocessor, the locking mechanism is operated by the external control unit in the following way. The two poles of the two-pole wire connector are electrically connected with each other or disconnected from each other by second switch mechanism, which is arranged for closing or breaking a current circuit from the relay in the first power supply. As a consequence of the closing or breaking of the current circuit, the first power supply is caused to operate supply of current to the locking mechanism from the first power source via the first wire connection.

In advantageous embodiments, the external control unit comprises connection ports that can provide current to a lock and ports that can be used for closing or breaking existing electrical circuits. This makes the external control unit versatile.

For example, relatively to the explanation above, the external control comprises

- a housing;
- the second power supply, for example a battery, the battery optionally being provided inside the housing;
- inside the housing a microprocessor and a short range wireless digital data signal transceiver configured for receiving digital data commands from a mobile device and which is electronically connected to the microprocessor and configured for transmission of digital data signals between the transceiver and the microprocessor;
- a first electrical connection port in the housing for receiving electrical power from the second power supply and providing this electrical power to the lock by a wire connection between the first connection port and the lock; wherein the microprocessor is operationally connected to the first connection port via a first switch mechanism for causing switching on and off the current through the first connection port according to programmed operational steps, a further electrical connection port provided with a two-pole connector and with a second switch mechanism between the two poles of the two-pole connector for electrically connecting or disconnecting the two poles with each other for operating the lock by connecting or breaking a current circuit; the microprocessor being operationally connected to the second switch mechanism for causing the second switch mechanism to electrically connect or disconnect the two poles with each other according to programmed operational steps.

Optionally, the further connection port comprises a second electrical connection port with a second two-pole connector, and the second switch mechanism comprises a fail-open relay that disconnects the two poles of the second two-pole connector in default condition and connects the two poles of the second two-pole connector in operationally-active condition caused by supply of current to the fail-open relay; and wherein the further connection port comprises a third electrical connection port with a third two-pole connector and the second switch mechanism comprises a fail-closed relay that connects the two poles of the third two-pole connector in default condition and disconnects the two poles of the third two-pole connector in active condition caused by supply of current to the fail-closed relay.

For voltage adjustment, the first switch mechanism is digitally connected to the microprocessor for receiving and executing digital commands for adjustment of the voltage at a current exit of the transformer, the current exit being connected to the first electrical connection port.

Such external control unit can be used for electrically operating a door lock as a secondary tool in addition to a first electrical door locking mechanism.

For example, in practice, the mobile device is configured for short range wireless digital data signal communication. Prior to locking or unlocking, a short range wireless digital data communication link is established between the mobile device and the microprocessor of the external control unit and digital data are exchanged between the mobile device and the microprocessor by the short range wireless digital data communication link. For example, this initial data exchange is used for recognition, handshaking and potentially also for creating an encrypted communication line.

Once the microprocessor is ready for receiving a command for locking or unlocking the door, a command session between the mobile device and the microprocessor is initiated and, as part of the command session, an operation command is sent from the mobile device to the lock for locking or unlocking of the lock. As a result of the receipt of the operational command by the microprocessor, the microprocessor, which is functionally connected to the first connection port in the external control unit, causes the first connection port to provide electrical current for the lock via the third wire connection. This current is causing the lock to correspondingly lock or unlock. This current is provided either directly to the driving unit, or the current is provided to the relay that controls the flow of current through the driving unit. Correspondingly, a magnetic lock can be operated in this way.

In case of retrofit for different types of older locks, the external control unit has to be adjusted to fit the electrical requirements for the door lock. For example, this can be done by programming the microprocessor, by providing a suitable transformer inside the external control unit or by re-wiring inside the external control unit. However, in order to facilitate mounting, the external control unit is advantageously already provided with a number of installed alternatives for connection to various locks. In such case, for the various alternatives, a plurality of connection ports are provided, for example one or more of these configured for providing current in the range of 12V-24V for directly controlling a driving unit of the locking mechanism in the lock or configured for providing electrical signals causing a relay of the door lock to lock or unlock the door lock for the case that the door lock is a fail-open or fail-closed type of lock. In a simple version, the external control unit can swap between 12 V and 24 V upon command by the microprocessor, the latter being programmable to cause the correct voltage adjustment.

For example, if the relay is constantly provided with electrical power from a power source in order to provide power to the locking mechanism constantly to keep the door closed, which is a "fail-open" condition, a connection port may be connected serially in the wire between the power supply and the relay and be provided with a switch to cut the power to the relay in order to cause opening of the door lock by the external control unit.

The driving unit is activated by current from the external control unit in addition to the functions that are already present for the door lock without the retrofitted external control unit. For example, the driving unit would then extend or retract the lock bolt into or from a notch in the door frame, determined by the current from the external control unit. Alternatively, moveable shutter in the door frame would be moved by the driving unit in order to release a deadbolt.

Optionally, the external control unit can be operated with an external power source that is wired to the external control unit. Alternatively, or in addition, the external control unit is provided with a battery inside the housing, wherein the battery is electrically connected to the microprocessor for providing current to the microprocessor.

In some embodiment, the battery is functionally connected to a connection port, for example the first connection port, for providing current to it. In such case, it is necessary that the battery provides the proper voltage. If the battery has voltage less than 12 volts, a transformer may be provided and the voltage stepped-up from the battery voltage to a desired value, typically in the interval of 12V-24V. This stepped-up current is then provided to the respective connection port.

In some embodiments, the system also provides increased safety against so-called sniffing and subsequent fraudulent opening of doors. Sniffing is an unauthorized action where the wireless signal is read by electronic receivers operated by unauthorized persons, so called "man-in-the-middle", who later use the read signal to open the door in the attempt of burglary.

For increased security, especially against sniffing and hacking, it is advantageous if digital encryption is used for the command to lock or unlock. For example, as part of the command session, a session encryption key is created by the mobile device or by the microprocessor of the external control unit or by both in cooperation. This encryption key is then used for encryption and decryption of the digital data that are exchanged between the mobile device and the microprocessor by the short range wireless digital data communication.

In order to prevent sniffing of the encrypted signal and later unauthorized use of it, advantageously, the encryption key is only valid for a short period. This implies that the operation command is only executed by the external control unit if the execution is within a predetermined time limit. For example, such predetermined time limit is calculated as a predetermined time period that runs from a digital time stamp that is submitted as part of the encrypted operation command. For example, the duration of the time period is a few second, optionally 3 seconds.

In a practical embodiment, the session encryption key has validity at most until the predetermined time limit, and the operation command is carried out by the external control unit only if session encryption key is valid at the time of decryption. If the encryption key is not valid, the decryption may not be carried out, and the external control unit does not perform any locking or unlocking action. It should be emphasized that the decryption and execution of the operation command are regarded as quasi simultaneously for practical purposes, because the time span between the decryption and the execution of the command is short as compared to the predetermined time period. These measures reduce the risk for fraudulent unlocking of doors.

In certain embodiments, if the locking or unlocking is prior to the predetermined time limit, the encryption key is only valid until the instance of locking or unlocking by the external control unit. Thus, in the case where the unlocking or locking action is performed prior to the predetermined time limit, this action overrules the predetermined time limit and the encryptions key loses its validity as soon as the locking or unlocking is performed, even in the event that the predetermined time limit is later than the decryption and execution of the operation command. This implies the advantage that one encryption key can only be used once for locking or unlocking; no re-use of a session encryption key is possible for repeated locking or unlocking. For example, in the event of locking by an authorized person, unauthorized third parties cannot use the same encryption key for a subsequent unlocking action, even if the time span between the locking and unlocking is short.

The external control unit in cooperation with the mobile device can be digitally connected periodically to a remote security server system. The server system can be used to receive and store log files and is involved in dedicated parameter settings of the external control unit, such as automated locking or unlocking at certain times each day. For such session, session encryption keys are used, as well, if the transmission of data is desired to be encrypted for such other sessions.

As it appears from the above in relation to the encrypted communication, the retrofit allows upgrading of old type locks to highly advanced modern door locks at minimum effort and cost.

The mobile device, for example a smartphone, as mentioned above, can be provided with a suitable computer application, a so-called APP, in order to enhance the versatility of the system. For example, the APP can be used to associate the smartphone with a plurality of external control units, each unit connected to one of a plurality of door locks.

If a mobile device is associated with a plurality of external control units connected to a similar number of retrofitted door locks, the method, optionally, involves the following more detailed steps. Prior to establishing a command session between the mobile device and one of the control units, a short range wireless digital data communication link is established between the mobile device and the microprocessors in all the plurality of external control units, and wireless digital data are exchanged, for example without encryption, between the mobile device and the plurality of external control units. From each microprocessor of the plurality of external control units, a unique identifier, ID, of the corresponding external control unit is submitted to the mobile device and checked for authorization. The authorized individual IDs are received on the mobile device and are displayed on a user interface of the mobile device. The user may then select one or more of the IDs among the other identifiers on the user interface, and give an indication, such as a pointer action on the user interface or a keyboard action on the mobile device for which door lock to lock or unlock. As a response to the indication, a command session is initiated and executed only with that specific external control unit or those specifically selected external control units that correspond to the specifically selected ID or IDs.

Alternatively, or in addition, a simplified method is used. In this embodiment, a short range wireless digital data communication link is established between the mobile device, for example smartphone, and the external communication unit as soon as the mobile device is within a communication range with the external control unit. Thus, no action from the user is required. As a response of the established communication link with a short-range communication signal strength being above a pre-set level, for example the pre-set level being above 20% of a maximum signal strength, automatically initiates the command session without interference from a user and causes an unlocking action. This is very practical for the user in that the mobile device can be kept inside the pocket or bag, and the door would open just when coming near to the door.

The control unit is suitable for retrofit in connection with old, already existing and already mounted electromechanical or magnetic door locks. However, it is also possible to use the system for new locks which are of simple character in order to enhance the functionality.

The term "door lock" is to be understood broadly and also covers garage ports and ports for estates, among others.

BRIEF DESCRIPTION

Some of the embodiments will be described in detail, with references to the following Figures, wherein like designations denote like members, wherein.

DETAILED DESCRIPTION

Figure 1:
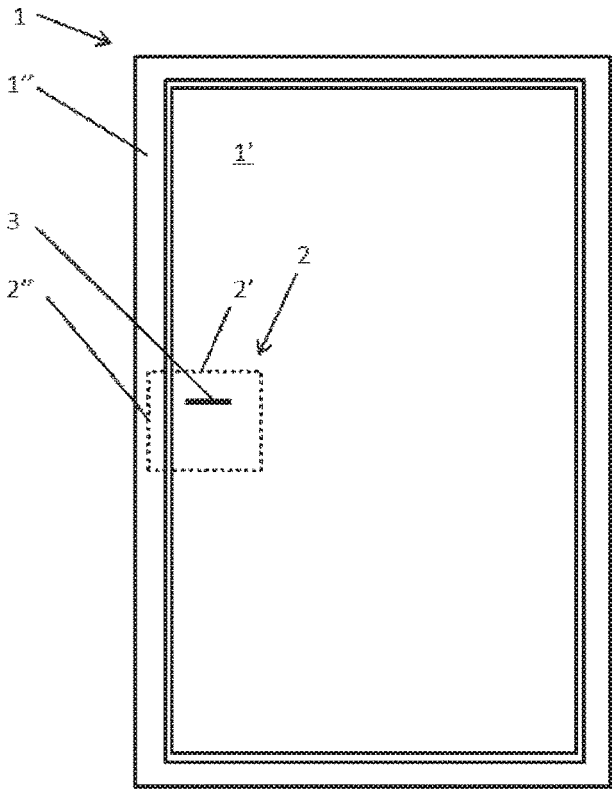
FIG. 1 is a principle sketch of a door with a door lock.

FIG. 1 illustrates a door 1 with a door panel 1' that is swinging in and out of a frame 1". The door 1 comprises a door lock 2 with a first lock part 2' in the door panel 1' and a second lock part 2" in the frame 1". The first lock part 2' and the second lock part 2" are interacting for locking the door 1. For example, the first lock part 2' is a lock module with a movable lock bolt and the second lock part 2" is a recess in which the lock bolt engages for locking. Alternatively, the second lock part 2" is a movable strike faceplate that releases a lock bolt from the locked position by moving away from the lock bolt. A further alternative is a magnetic lock, where a magnetic field is electrically created to hold an electromagnet against an opposite magnetically interacting pole.

In the following, the device is explained in relation to a movable lock bolt, however, the principles are universal and also apply for all three types of locks as mentioned above as well as further electromechanical types of locks.

Figure 2:
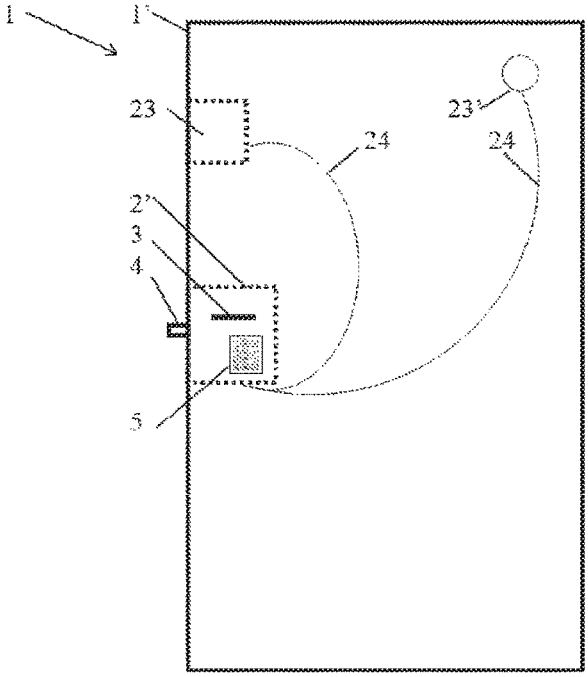
FIG. 2 is a drawing of a door with an electromechanical door lock.

FIG. 2 shows a door 1 with a door panel 1' in which a first door lock part 2' of a door lock 2 is mounted. The first door lock part 2' comprises a handle 3 that, when depressed, retracts a movable locking element, which in this illustrated case is a movable lock bolt 4 that engages with a catching recess in the door frame 1" when extended and which is free from the catching recess when retracted. As an alternative or in addition to the handle 3 for operating the locking element to open or lock the door 1, a keypad 5 with alphanumerical keys is used. Input of an alphanumeric code causes the keypad 5 to submit electronic data representing the code to an integrated circuit, which in turn activates a driving unit, for example electrical motor or solenoid, that activates the locking element, particularly moves the lock bolt 4 into or out of the door panel 1' and respectively out of or into the catching recess. Alternatively, the door lock 2 could be of a different type, there the handle 3 retracts a strike plate into an opening position. As a further alternative or in addition to the keypad 5 or and handle 3, the first door lock 2 is equipped with a wireless receiver in functional connection with the locking element for receiving and executing wireless digital commands for locking or unlocking the door.

Figure 3:
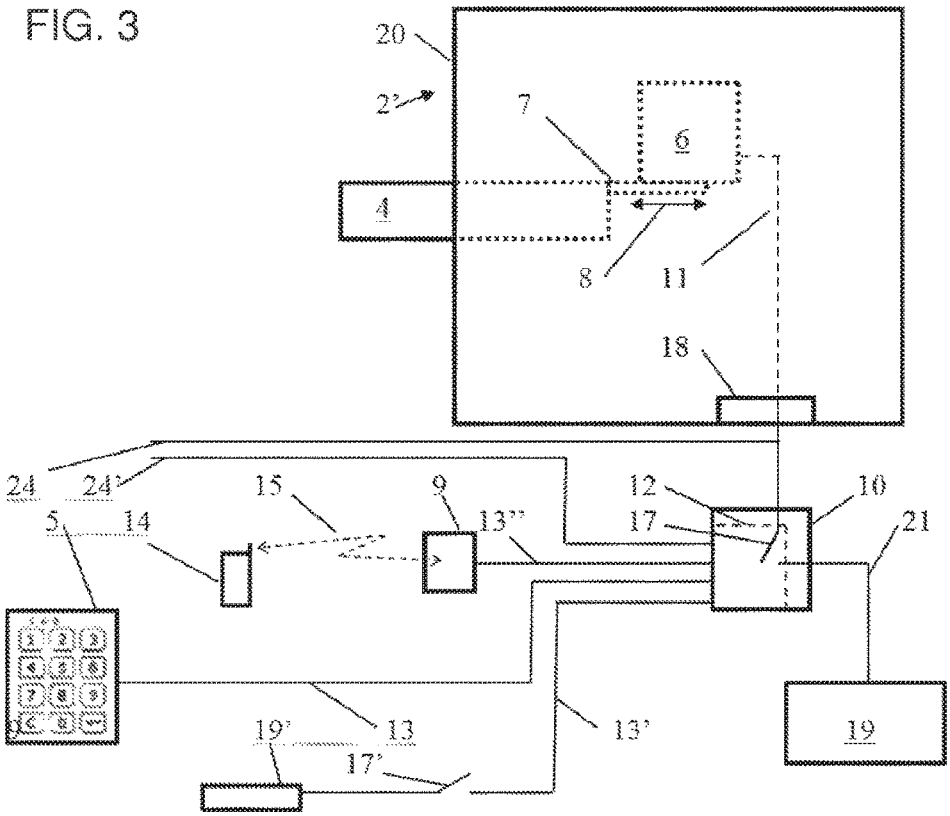
FIG. 3 is a principle sketch of a door lock with a control system.

FIG. 3 illustrates an example of a lock part 2' with a casing 20. The first lock part 2' comprises the lock bolt 4, which extends into the casing 20 and is connected by a connector 7 to a driving unit 6, for example a motor or solenoid, inside the casing 20 such that the lock bolt 4 can be driven in and out of the casing 20, as indicated by the double arrow 8. The driving unit 6 receives electrical current through electrical wire 11. There are multiple possibilities to receive this electrical current, for example by the wire 11 extending out of the casing 20 and being connected to a power source, or the wire 11 being connected to an electrical port 18, typical a socket for a multi-pin connector. The electrical port 18, or the wire 11 directly, receives electrical power, typically a 12V or 24V voltage signal, the supply of which causes the driving unit 6 to be activated for retracting and/or extending the bolt 4.

As mentioned before, the lock 2 can be of a different type where the electrical power from such electrical port or from the wire 11 is used for activating a strike plate in a frame 1" or a magnetic lock. The principles apply equally well.

The power delivered to the port 18, or to the wire 11 directly, is provided from a first power supply 10, as illustrated in FIG. 3. For example, the first power supply 10 comprises a switch 17, which when closed conducts power, received by the first power supply 10 from a power source 19, through the first power supply 10 and delivers it to the driving unit 6 through port 18, or directly through wire 11 if the lock 2 does not have such port 18. For example, the power source 19 is an external power source.

In the simplest for, the first power supply 10 comprises a manual push button, which upon pressing or, alternatively, upon release closes the switch 17, which in turn closes the power circuit from the power source 19 through electrical wire 21, optionally through port 18, and through electrical wire 11 to the driving unit 6.

Alternatively, the first power supply 10 comprises an electrical relay 12 which is electrically activated or deactivated, by an electrical signal. For example, such signal is received from a keypad 5 through wire connection 13 and/or from a manual push button switch 17' through a different wire connection 13', optionally, electrically fed by current from a battery 19' or other type of power supply. Alternatively, the push button switch 17' is used to break a current circuit from the first power supply 10. Whether activation of the first power supply 10 occurs by supplying a current to the relay 12 or by breaking a current circuit from the relay 12 or by closing a current circuit to the relay 12 depends on the type of relay 12.

An alternative or addition is a remote control 14, the wireless signal 15 of which is received by a receiver 9 which, when activated, operates the switch 17, for example by delivering current to the relay 12 of the first power supply 10 through wire connection 13" or by breaking a current from the relay 12 in the first power supply 10.

For example, third wire connection 24 to the port 18 or the wire 11 directly is provided from an external control unit for controlling the lock 2. Optionally, an alternative third wire connection 24' into the relay 12 of the first power supply 10 is provided from the external control unit as an additional electrical control mechanism. Such options are explained in more detail below.

The current pulse delivered to the first power supply 10, in case of the power supply containing a relay 12, is optionally used to unlock the door 1, keep it unlocked, or lock the door 1. Alternatively, a steady current circuit from the first power supply 10 must be broken or closed to cause locking or unlocking of the door. Different systems exist and various combinations are possible.

For example, an integrated circuit comprises a timer-based programming such that the door 1 is by default unlocked through daytime and locked at night time. In order to lock the door through daytime, a power input to the relay 12 is necessary and for opening the door at night time, a breakage of a power supply is necessary.

The electrical pulse delivered to the first power supply 10 is of various kinds, dependent on the purpose and necessity. For example, for driving a driving unit 6 with a lock bolt 4, the pulse needed for unlocking and locking can be relatively long. In contrast thereto, the pulse length needed for a strike lock, typically, is relatively short. A pulse needed to break the magnetic force between door panel 1' and door frame 1" in a magnetic door lock can be relatively short, while the current necessary to hold it closed is relatively long. Dependent on the type of lock 2, the signal to the electrical relay 12 has to be managed accordingly. Whether the current causes locking or unlocking depends on whether the door lock 2 of the type where it is locked or unlocked in case of power failure, which is typically termed "fail-locked" and "fail-unlocked", respectively. Alternative terminology uses "fail-closed" and "fail-open".

The first power supply 10 is shown as external to the casing 20 but could in principles also be provided inside or on the casing 20. The power source 19 is typically provided outside the casing 20, although this is not strictly necessary.

With respect to remote controls 14, typically, for each type of lock 2, there is a special communication system such that a remote control 14 that works for one lock 2 or type of lock 2 does not work for another lock 2 or another type of lock 2. In order to provide a universal locking and unlocking system, the following improvement is provided.

With reference to FIG. 2, an external control unit 23 is provided as an additional control of the lock 2. The external control unit 23 is electrically connected by an external wire 24 to the electromechanical lock 2, or alternatively, by an external wire 24', as shown in FIG. 3, to the first power supply 10, especially if this first power supply 10 comprises an electrical relay 12. Such an external control unit 23 is potentially integrated or inserted into the door panel 1'. Alternatively, such external control unit 23' is mounted onto the door panel 1', or equivalently onto a door frame 1"

around the door panel 1'. A wire can be used to cross over from the door frame 1" to the door panel 1', for example through a hinge. Other locations near the door 1 are possible, for example a wall mounting. If the door lock 2 is a strike lock with the strike plate in the door frame 1", the external control unit 23 and the wire 24 would correspondingly be placed in or on the door frame 1".

It is pointed out that the system with the lock bolt 4 is exemplary, and the external control unit 23 can also be applied to magnetic locks where a door panel 1' is held against a frame 1" by magnetic interaction.

Figure 4:
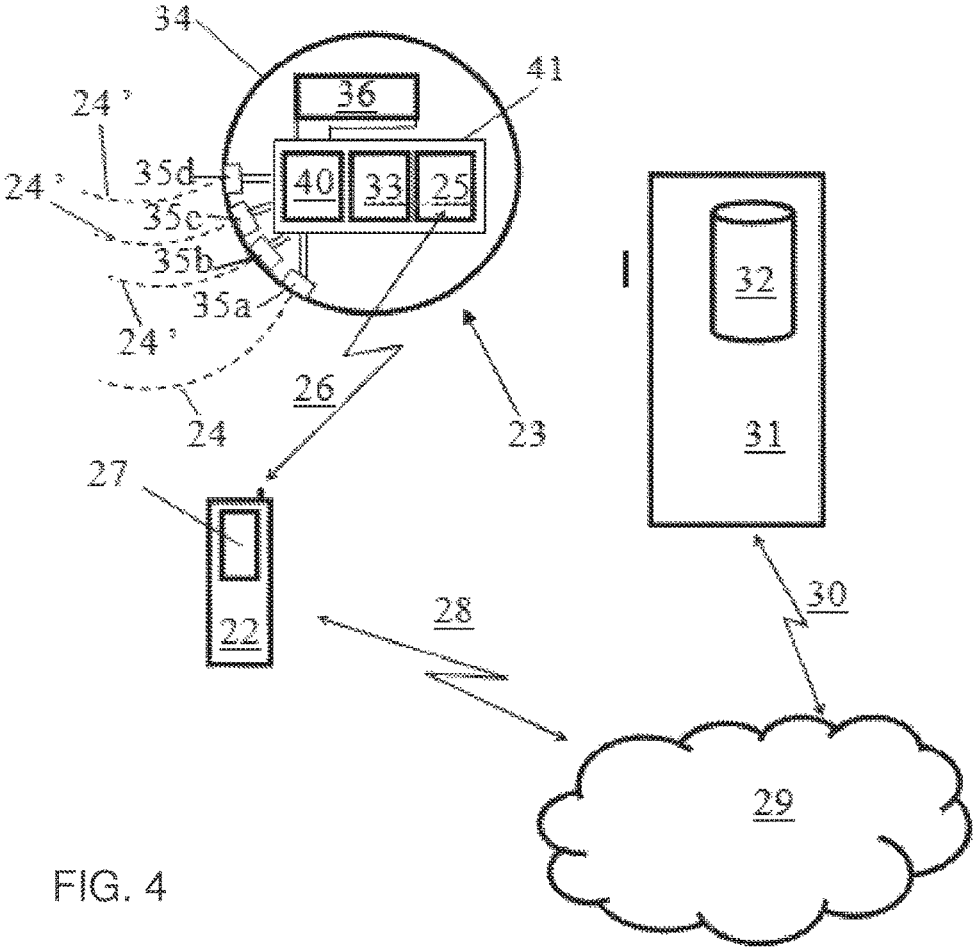
FIG. 4 is a principle sketch of an external control unit and system for controlling the door locks, for example as a retrofit.

FIG. 4 illustrates an example of the functioning of such an external control unit 23. The external control unit 23 is operated by wireless communication 26 with a mobile device 22, typically a mobile telephone. The external control unit 23 comprises a transceiver 25 and a microprocessor 33 which are functionally and electronically connected. They are typically incorporated within the housing 34 of the external control unit 23, although, they could also be provided externally and functionally connected to the external control unit 23. In the following, it is assumed that the transceiver 25 and the microprocessor 33 are inside the housing 34 of the external control unit 23, although, embodiments of the invention can easily be modified for an external communication and control module 25. Computer programs for the functioning of the external control unit 23 are stored and executed by the microprocessor 33. The transceiver 25 is configured for digital communication with mobile device 22 via a short range wireless protocol communication line 26 when the mobile device 22 is in proximity of transceiver 25 of the external control unit 23.

In the event that the transceiver 25 receives a digital wireless control signal for unlocking or locking the door lock 2, the signal is sent vie the transceiver 25 to the microprocessor 33, which initiates a corresponding electrical signal through one of the connection ports 35*a*, 35*b*, 35*c*, 35*d*, depending on the setup of the external control unit 23.

The term electrical signal is used here for various electrical operations of the external control unit 23, such as

- sending a voltage pulse out of first connection port 35*a* or first alternative connection port 35*b*, typically a 12-24 V pulse;
- closing a current circuit between two wires that are connected to a second two pole connection port 35*c*; or
- breaking a current circuit between two wires that are connected to a third two pole connection port 35*d*.

Due to the relatively small number of various signals for operating door locks 2, the external control unit 23 is provided with a plurality of connection ports 35*a*, 35*b*, 35*c*, 35*d* with cable sockets. For sake of illustration, the number of ports shown are four, however, a different number of ports is possible, for example 3, 5, 6, 7, 8, 9, or 10 ports. Typically, however, at least three ports for example four, are used for the external control unit 23 to be versatile as explained in the following.

In some embodiments, the external control unit comprises one power exit 35*a* for feeding a driving unit directly with current, for example 12V-24V power through wire 24 and wire 11 and an additional connection port 35*b* for feeding power to the relay 10. In other embodiments, the two ports 35*a* and 35*b* are combined in a single first connection port 35*a*

For example, in order to provide a 12-24 volts power signal from the external control unit 23, the external control unit 23 is electrically connected to the power grid, such as to 110V or 220V current, optionally comprises a transformer 40 for reducing the voltage. Alternatively, or in addition, a battery system 36 is incorporated in the external control unit 23. For example, the external control unit 23 is provided with a transformer 40 and a 3.3V battery is stepped up to 12-24V with the transformer 40, in which case a power supply from the power grid is supplemented in case of power failure of the power grid connection is not needed. The latter is an advantage, as it facilitates the installation, especially, in retrofit situations. In FIG. 4, the transformer 40 as well as the microprocessor and the transceiver 25 are shown as part of an integrated circuit board 41 which is connected with wires to the connection ports 35*a*, 35*b*, 35*c*, 35*d* and to the contacts of the battery 36. Not all components on the integrated circuit board 41 are illustrated for sake of simplicity.

For example, the external control unit 23 is set up to send electrical current, typically a 12V-24V current, from a first electrical connection port 35*a* via wire 24 to port 18 of the door lock 2 and further via wire 11 to driving unit 6 for causing the driving unit 6 to lock or unlock the door, respectively, by activating the lock bolt 4 or, alternatively, the strike plate. This possibility of locking or unlocking the door by external control unit 23 through first electrical connection port 35A is provided in addition to the existing control system of the lock 2 which was described in connection with FIG. 3.

Alternatively, the external control unit 23 is set up to send electrical current via an alternative first connection port 35*b* and alternative wire 24' to the first power supply 10 of the lock 2, in particular the relay 12, in order to cause opening or locking of the door lock 2. However, if the signal for the relay 12 is of the same type than used for feeding a lock 2 directly, for example a 12-14 V signal, the alternative first connection port 35*a* can be used and programmed for both feeding current directly to the lock 2, for example the port 18, and for feeding current to the relay 12. The latter is also possible if the voltage and current in the first connection port can regulated correctly and suitably by the microprocessor 33 in co-operation with a regulated transformer.

Whether the current for the relay 12 causes locking or unlocking depends on whether the door lock 2 is of the type where it is locked or unlocked in case of power failure, which is typically termed "fail-locked" and "fail-unlocked", respectively.

Potentially, the different connection ports 35*a*, 35*b*, 35*c*, 35*d* are not only configured for different standards of electrical current through electrical port 18 of the lock 2, but may, optionally, also be configured with different types of sockets for different types of connectors.

For some types of relay, the relay 12 has a two-pole relay port, where an electrical connection between the two poles causes one type of operation and the disconnection causes another type of operation. In order to operate such relay, the external control unit 23 has two ports 35*c* and 35*d*, one of which is connected to this type of relay 12 via wire 24'. Each of the two ports 35*c*, 35*d* has a two-pole connector. The second connection port 35*c* has a disconnection of the two poles as default and causes connection of the two poles upon electrical activation. The other port 35*d* has a connection of the two poles as default and causes disconnection upon electrical activation. By using either the second connection port 35*c* or the third connection 35*d* for a connection via wire 24' to the relay 12, the external control unit 23 can be adapted to the specific type of relay 12. Depending on which port is most suitable depends also on whether it is used for system of "fail-locked" and the other is used for systems of "fail-unlocked".

Figure 5:
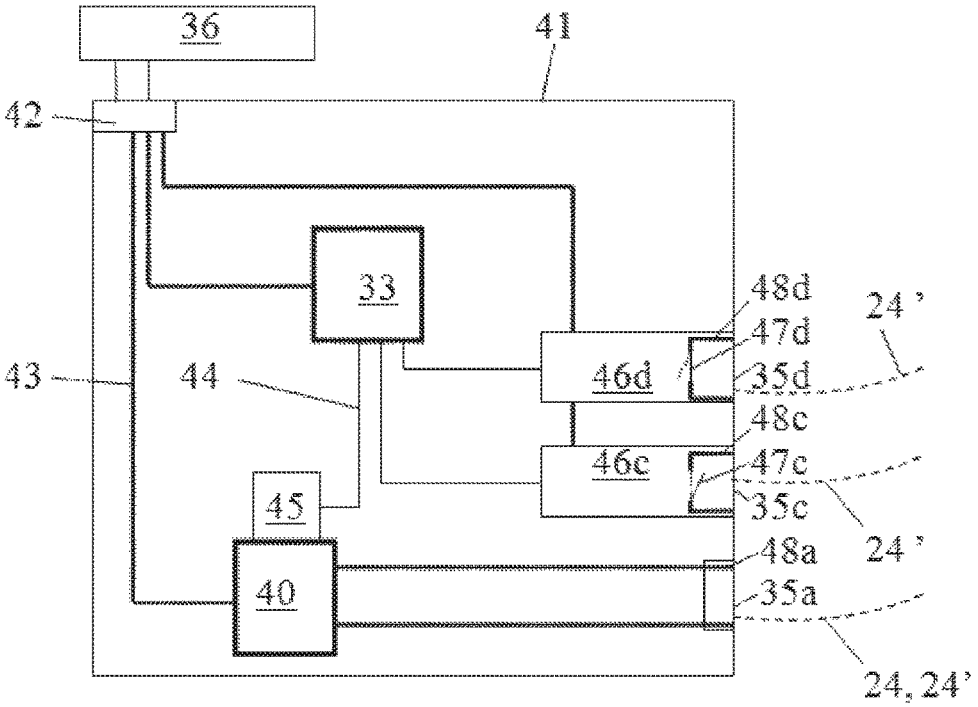
FIG. 5 is a sketch of an integrated circuit board with three connection ports.

FIG. 5 illustrates an example of an integrated circuit board 41 in which the microprocessor 33 and the transformer 40 are shown, although further elements can be integrated, for example the transceiver 25. Not all components on the integrated circuit board 41 are illustrated for sake of simplicity. Electrical current supply connections 43 in the board 41 are shown as thicker lines, whereas electronic command lines 44 are shown as thinner lines. The board 41 received electrical power through the electrical input 42 from a battery 36, the voltage of which is stepped up by a transformer to 12 V or to 24 V as controlled by a switching mechanism 45, which is electronically connected to the microprocessor 33 and which received electronic instructions from the microprocessor 33 in order to switch between on and off the current from the transformer and between various voltages, for example 12 V and 24 V or a voltage within a preprogrammed range, upon instructions from the microprocessor 33. The current with the stepped-up voltage is accessible by electrical wire connectors 48*a* in first electrical port 35*a*. The first electrical port 35*a* also takes the role of the earlier described alternative first electrical port 35*b*. Instead of the battery 36, a different electrical power source is possible, for example electricity from the grid. With reference to FIGS. 3 and 5, either the third wire connection 24 between connection port 35*a* and driving unit 6 is connected or the alternative third wire connection 24' between the first connection port 35*a* and the first power supply 10.

The microcontroller 33 also controls a first relay 46*c* of the circuit board 41, which is a fail-open relay, and the first relay switch 47*c*, which is closed when power is supplied to the first relay upon instructions from the microcontroller 33. When the first relay switch 47*c* is closed, the two-pole connector 48*c* in the second connection port 35*c* are electrically connected such that an electrical circuit from the relay 12 of the first power supply 10, as illustrated in FIG. 3 is closed. Furthermore, the microcontroller 33 also controls a second relay 46*d* of the circuit board 41, which is a fail-closed relay, and the second relay switch 47*d*, which is open when power is supplied to the second relay 46*d* upon instructions from the microcontroller 33. When the second relay switch 47*d* is open, the two poles in the two-pole connector 48*d* of the third connection port 35*d* are electrically disconnected such that an electrical circuit from the relay 12 of the first power supply 10, as illustrated in FIG. 3 is broken. With reference to FIG. 3, the alternative third wire connection 24' is connected between connection port 35*c* or 35*d* and the first power supply 10.

The external control unit 23 is suitable for retrofit and upgrade of existing electromechanical door locks 2. The advantage for the consumer is the availability to upgrade existing locks 2 with a high-tech door lock control system including wireless application by a mobile device 22, such as a telephone, without the need of exchanging the lock 2. As explained in detail above, the retrofit system has the potential not only for electrical connection to the driving unit 6 but also to a relay 12, as shown by the first power supply 10 in FIG. 3.

For such retrofit system, there exist different requirements with respect to the electrical current that has to be applied. Some locks need a voltage of 12 V while others need 24 Volts. Some locks, such as doors with electrical door strikes, need a short signal, for example of less than one second, for withdrawing the locking element, for example strike plate, with a solenoid while others need a longer signal, for example between one and 5 seconds, while a motor is driving the locking element, for example lock bolt, in or out of locking engagement. Others again need a short signal to break a constant magnetic force in a magnetic lock. Despite the variety of signal requirements for various locks, international standardization implies that the overall number of different systems with respect to the requirements for input through electrical port 18 are relatively few for the majority of electromechanical locks on the market. Correspondingly, for the majority of locks 2 on the market that also are equipped with an external port, there exist relatively few standards for external control through port 18. For example, many door locks operate at a voltage in the range of 12V-24V. The microcontroller 33 is accordingly programmable for controlling the delivery of a pulse length and voltage that is useful for the connected lock 2.

As illustrated in FIG. 4, the system also comprises a digital data server system 31 for initial authentication of the external control unit 23 and the mobile device 22 and for updates of the data related to the communication between the mobile device 22 and the external control unit 23. Communication 28, 30 between the mobile device 22 and the server system 31 is done via the Internet 29. The server system 31 comprises a computer readable memory 32 and a processor for storing and executing computer programs and comprises an encryption engine that is configured to process authentication requests from the mobile device 22 in connection with the initiation of a control function for the external control unit 23. Also, log files are transmitted to the server and stored in the database.

When the mobile device 22 is in proximity of the external control unit 23, a wireless connection 26 is established between the mobile device 22 and the microcontroller 33 via the transceiver 25 of the external control unit 23. The wireless connection 26 is typically established according to a short-range wireless protocol, for example Bluetooth, Wi-Fi or Zigbee. If the external control unit 23 has been pre-configured in a memory of the mobile device 22, the mobile device 22 sends operational commands to the transceiver 25 and microprocessor 33 of the external control unit 23 through the wireless connection 26, for example upon user input from a user interface 27 displayed on the mobile device 22, such as a touch screen interface. The mobile device 22 is equipped with a corresponding computer application therefore. For example, the mobile device 22 is a smart phone comprising a so called "App", which is specific term for an interactive computer application in a smart phone. For example, the user may be prompted to select a unique individual identifier ID of the external control unit 23 in a list on the user interface 27 of the mobile device 22 by a pointer action or other indication method and initiate the operation of the specifically selected external control unit 23. The microprocessor 33 in the external control unit 23 is programmable for activating the correct one of the connection ports 35*a*, 35*b*, 35*c*, 35*d* for providing electrical current to the driving unit 6 in the lock 2 via port 18 or via the relay 10 or whether a current circuit has to be closed or broken.

Alternatively, the mobile device 22 is programmed to automatically instruct the microprocessor 33 of the external control unit 23 to provide an electrical current to the lock 2 for causing unlocking when the mobile device 22 is within short range of the external control unit 23, the range given by the range necessary for the short-range communication link on the wireless connection 26.

As it appears from the above description, the system with the external control unit 23 is very useful for retrofit in existing locks 2, where the normal and original operation mode of the lock 2 can be maintained, for example the operation with the numerical keypad 5 or remote control 14, and the high-tech operation with a mobile device 22 can be added in a simple way. The addition of the function with the mobile device 22 implies the option of increasing the comfort for the user but also increasing the safety, as the software system can be frequently updated with newest safety features, including advanced encryption algorithms, through the server system 31 via the Internet 29, which reduced the risk for unauthorized access, for example by so called hacking or sniffing of the wireless signals of the remote control 14.

As mentioned above, the retrofit can be performed for locks with lock bolts or strike locks. Even for magnetic locks, the retrofit can be used. Other options are available in the art, and the important aspect of embodiments of the invention is that an electromechanical lock with a port 18 can be upgraded to a high-tech opening system with a mobile device 22, typically a mobile phone. The connection ports 35*a*, 35*b*, 35*c*, 35*d* of the external control unit 23 can be configured to fit the specific type of lock. For ease of use, the external control unit 23 is provided with corresponding connection ports 35*a*, 35*b*, 35*c*, 35*d* that are suitable for the predominant type of lock in the corresponding market where the external control unit 23 is sold. The user can then select the correct from the plurality of connection ports 35*a*, 35*b*, 35*c*, 35*d* port for connection to the door lock 2.

The term "door" is also meant to cover doors in a broad sense, for example, also including garage ports and entrance ports for estates in general.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

NUMBER REFERENCES

1 door
1' door panel
1" door frame
2 electrically activated door lock
2' first lock part
2" second lock part
3 handle
4 lock bolt
5 keypad, option as first controller
6 driving unit
7 connector between driving unit 6 and lock bolt 4
8 arrow indicating motion of lock bolt
9 receiver
10 first power supply
11 first wire connection for power to the driving unit 6
12 relay in first power supply 10
13 wire connection from keypad 5 to first power supply 10
13' wire connection between button switch 17' and first power supply 10
13" wire connection between receiver 9 and first power supply 10
14 remote control, option as first controller
15 wireless signal from remote control 1417 switch in first power supply 10
17' button switch, option as first controller
18 electrical port in lock 2 for supply of current to the driving unit 6
19 power source
20 casing of external control unit 23
21 second wire connection
22 mobile device
23 external control unit
24 third wire connection between connection port 35*a* and driving unit 6
24' alternative third wire connection between connection port 35*b*, 35*c*, 35*d* and first power supply 10
25 transceiver in external control unit 23
26 wireless connection between mobile device 22 and transceiver 25
27 user interface of mobile device 22
28 communication between mobile device and internet 29
29 internet
30 communication between internet 29 and server system 31
31 server system
32 memory of server system 31
33 microprocessor in external control unit 23
34 housing of external control unit 23
35*a* first electrical connection port of external control unit 23 for feeding wire 11 directly 35*b* alternative first electrical connection port of external control unit 23 to feed first power supply 10
35*c* second electrical connection port for closing electrical circuit from first power supply 10
35*d* third electrical connection port for breaking electrical circuit from first power supply 10
36 power supply, ex. battery
37 electrical connection between port 35*a-d* and power supply 36
40 transformer
41 integrated circuit board in external control unit 23
42 circuit board electrical input
43 electrical connections in circuit board
44 control lines
45 switching mechanism for transformer 40
46*c* fail-open relays
46*d* fail-closed relays
47*c* switch in fail-open relays 46*a*
47*d* switch in fail-closed relays 46*b*
48*a* electrical two pole wire connectors in first electrical connection port 35*a*
48*c* electrical two pole wire connectors in second electrical connection port 35*c*
48*d* electrical two pole wire connectors in third electrical connection port 35*d*

The invention claimed is:

1. A method for retrofitting an external control unit to an existing electrically activated door lock in a door and causing locking and unlocking of the door lock by the retrofitted external control unit, wherein the door lock comprises a locking mechanism that is electrically controllable for keeping the door closed or open upon activation of the locking mechanism by electrical power;

a first power supply electrically connected to the locking mechanism by a first electrical wire connection for causing activation or deactivation of the locking mechanism by electrical current from the first power supply to the locking mechanism through the first wire connection;

a first power source electrically connected to the first power supply by a second wire connection for providing electrical current to the locking mechanism via the first power supply;

a first controller functionally connected to the power supply for causing the first power supply switching on or off the electrical current from the first power source through the second wire connection, through the first power supply, and through the first wire connection to the locking mechanism;

wherein the method comprises providing an external control unit in addition to the power supply and the first power source and the first controller;

wherein the external control unit comprises a second power source different from the first power source and configured for supply of electrical current for activation of the locking mechanism;

a housing, and inside the housing a microprocessor and a short range wireless digital data signal transceiver that is electronically connected to the microprocessor for transfer of the digital data signals between the transceiver by the microprocessor;

a first electrical connection port in the housing connectable via a first switch mechanism to the second power source for receiving electrical current from the second power source; wherein the microprocessor is operationally connected to the first switch mechanism and configured for causing the first switch mechanism switching on and off the current through the first connection port according to programmed operational steps in the microprocessor, a further electrical connection port provided with a two pole wire connector with a second switch mechanism between its two poles for electrically connecting or disconnecting the two poles with each other for operating the lock by connecting or breaking a current circuit; the microprocessor being operationally connected to the second switch mechanism for causing it electrically connecting or disconnecting the two poles with each other according to programmed operational steps in the microprocessor.

the method further comprising electrically connecting the first connection port or the further connection port by a third wire connection to the lock as an additional control mechanism for locking or unlocking the lock;

providing a mobile device configured for short range wireless digital data signal communication and establishing a short range wireless digital data communication link between the mobile device and the transceiver and exchanging digital data between the mobile device and the microprocessor via the transceiver;

as part of the digital data exchange between the mobile device and the microprocessor, initiating a command session and sending a digital locking or unlocking command from the mobile device to the microprocessor and operating the first switch mechanism or the second switch mechanism by the microprocessor in accordance with the digital locking or unlocking command for causing corresponding locking or unlocking of the lock.

2. The method according to claim 1, further comprising identifying whether the door lock comprises a relay as part of the power supply or not, and in the case that the power supply does not comprise a relay, identifying the first connection giving electrical access to the locking mechanism and connecting the third wire connection to the first connection port of the external control unit and to the first wire connection; upon receipt of the digital command by the microprocessor, operating the locking mechanism by the external control unit by feeding current from the second power source through the first connection port of the external control unit to the locking mechanism via the third wire connection and via the first wire connection as a further mechanism of operating the lock.

3. The method according to claim 1, further comprising identifying whether the door lock comprises a relay as part of the power supply or not; and in the case that the power supply does comprise a relay, identifying whether the relay comprises a current input to the relay for operating the relay by an external current; in the affirmative, electrically connecting the third wire connection to the first connection port; upon receipt of the digital command and as a consequence thereof, operating the locking mechanism by the external control unit by feeding current from the second power supply via the first connection port via the third wire connection to the relay as part of the power supply as a further mechanism of operating the lock; or alternatively in the case that the first power supply does comprise a relay, identifying whether the relay has two current output poles for operating the first power supply in dependence of the current output poles being electrically connected to each other or not; in the affirmative, electrically connecting the two pole wire connector of the further connection port with the two current output poles of the relay in the first power supply by the third wire connection; as a consequence of receiving the digital command by the microprocessor, operating the locking mechanism by the external control unit by electrically connecting or disconnecting the two poles of the two pole wire connector with each other by a second switch mechanism and thereby closing or breaking a current circuit from the relay in the first power supply, and as a consequence of the closing or breaking the current circuit, causing the first power supply to operate supply of current to the locking mechanism from the first power source via the first wire connection.

4. The method according to claim 2, wherein the locking mechanism comprises a extendable-retractable lock bolt in a door panel of the door cooperating with a notch in a door frame; or wherein the locking mechanism comprises a movable shutter cooperating with a lock bolt; wherein the method comprises activating the driving unit by current from the external control unit, thereby extending or retracting the lock bolt or the moveable shutter.

5. The method according to claim 1, further comprising, providing a battery as part of the second power source inside the housing of the external control unit, the battery being electrically connected to the microprocessor, to the first and second switch mechanism, and to the first and further connection ports.

6. The method according to claim 5, wherein the battery has a voltage less than 12 volts and the method comprises providing a transformer and stepping-up the voltage from the battery to a value in the interval of 12V-24V, electrically connecting the battery to the first connection port through the transformer, and providing the stepped-up current to the first connection port.

7. The method according to claim 1, further comprising, as part of the command session, by the mobile device or by the microprocessor of the external control unit or by both in cooperation automatically creating a session encryption key and in encrypted form, by encryption with the session encryption key, exchanging digital data between the mobile device and the microprocessor by the short range wireless digital data communication link.

8. The method according to claim 1, further comprising, providing a plurality of door locks and an equal plurality of external control units and connecting one of each of such external control units to one of each of the plurality of door locks; prior to establishing a command session between the mobile device and one of the control units, establishing a short range wireless digital data communication link between the mobile device and the microprocessors in all of the plurality of external control units and exchanging wireless digital data without encryption between the mobile device and the plurality of external control units; from each microprocessor of the plurality of external control units submitting a unique identifier, ID, of the corresponding external control unit to the mobile device; receiving the individual IDs on the mobile device and indicating theses on a user interface of the mobile device, and by the mobile device receiving an indication from a user for selection of one of the IDs among the other identifiers on the user interface, the indication being a pointer action on the user interface or a keyboard action on the mobile device; as a response to the indication, initiating and executing the command session only with the external control unit that corresponds to the specifically selected ID.

9. The method according to claim 1, wherein the method comprises automatically establishing a short range wireless digital data communication link between the mobile device and the external communication unit when the mobile device is within a communication range with the external control unit, and as a response of the established communication link with a short range communication signal strength being above a pre-set level, the pre-set level being above 20% of a maximum signal strength, automatically initiating the command session without interference from a user and causing an unlocking action.

10. The method according to claim 1, wherein the method comprises, installing the locking mechanism in the door and operating the mechanism by the first power source, the first power supply and the first controller for at least one year; then at a later point in time retrofitting the external control unit to the lock as a second lock control mechanism.

11. An external control unit for connection to an electromechanical lock operated by a method according to claim 1, the external control unit comprising a power supply;

a housing, and inside the housing a microprocessor and a short range wireless digital data signal transceiver configured for receiving digital data commands from a mobile device and which is electronically connected to the microprocessor and configured for transmission of digital data signals between the transceiver to the microprocessor;

a first electrical connection port in the housing for receiving electrical power from the power supply and providing this electrical power to the lock by a wire connection between the first connection port and the lock; wherein the microprocessor is operationally connected to the first connection port via a first switch mechanism for causing switching on and off the current through the first connection port according to programmed operational steps, a further electrical connection port provided with a two-pole connector and with a second switch mechanism between the two poles of the two-pole connector for electrically connecting or disconnecting the two poles with each other for operating the lock by connecting or breaking a current circuit; the microprocessor being operationally connected to the second switch mechanism for causing the second switch mechanism to electrically connect or disconnect the two poles with each other according to programmed operational steps.

12. The external control unit according to claim 11, wherein the further connection port comprises a second electrical connection port with a second two-pole connector, and the second switch mechanism comprises a fail-open relay that disconnects the two poles of the second two-pole connector in default condition and connects the two poles of the second two-pole connector in active condition caused by supply of current to the fail-open relay; and wherein the further connection port comprises a third electrical connection port with a third two-pole connector and the second switch mechanism comprises a fail-closed relay that connects the two poles of the third two-pole connector in default condition and disconnects the two poles of the third two-pole connector in active condition caused by supply of current to the fail-closed relay.

13. The external control unit according to claim 11, wherein the power supply comprises a battery that is electrically connected to the first connection port through a transformer for stepping-up battery voltage from a value less than 12V to a value in the interval of 12V-24V.

14. The external control unit according to claim 13, wherein the wherein the first switch mechanism is digitally connected to the microprocessor for receiving and executing digital commands for adjustment of the voltage at a current exit of the transformer, the current exit being connected to the first electrical connection port.

15. The use of an external control unit according to claim 11 for electrically operating a door lock as a secondary tool in addition to a first electrical door locking mechanism.

* * * * *